US006073691A

United States Patent [19]

White

[11] Patent Number: 6,073,691

[45] Date of Patent: Jun. 13, 2000

[54] TORQUE RESISTANT RETRIEVABLE WHIPSTOCK

[75] Inventor: Pat M. White, Carrollton, Tex.

[73] Assignee: Halliburton Energy Services, Inc., Houston, Tex.

[21] Appl. No.: 09/038,405

[22] Filed: Mar. 11, 1998

[51] Int. Cl.[7] ..... E21B 43/14

[52] U.S. Cl. ..... 166/117.6; 166/117.5; 166/313; 175/81

[58] Field of Search ..... 166/50, 117.5, 166/117.6, 313; 175/80, 81

[56] References Cited

U.S. PATENT DOCUMENTS

| | | | |
|---|---|---|---|
| 3,095,039 | 6/1963 | Kinzbach | 175/81 X |
| 5,113,938 | 5/1992 | Clayton | 166/117.6 |
| 5,318,121 | 6/1994 | Brockman et al. | 166/313 |
| 5,398,754 | 3/1995 | Dinhoble | 166/117.6 |
| 5,467,819 | 11/1995 | Braddick | 166/117.6 |
| 5,474,126 | 12/1995 | Lynde et al. | 166/117.6 |
| 5,501,281 | 3/1996 | White et al. . | |
| 5,806,600 | 9/1998 | Halford, Sr. | 166/117.6 X |
| 5,871,046 | 2/1999 | Robison | 166/117.6 X |
| 5,884,698 | 3/1999 | Hughes et al. | 166/117.6 |

*Primary Examiner*—George Suchfield
*Attorney, Agent, or Firm*—Konneker and Smith

[57] ABSTRACT

A deflection apparatus is provided. In one described embodiment, the apparatus includes a torque resistant retrievable whipstock sealingly attached to a packer. The whipstock may be separated from the packer by applying an axial force to a first housing and thereby releasing a sleeve sealingly disposed between the first housing and a second housing for displacement relative to the second housing. The first housing and sleeve may then be removed from within the second housing, leaving a relatively large diameter seal bore attached above the packer.

26 Claims, 4 Drawing Sheets

TORQUE RESISTANT RETRIEVABLE WHIPSTOCK

BACKGROUND OF THE INVENTION

The present invention relates generally to equipment utilized in subterranean wells and, in an embodiment described herein, more particularly provides a torque resistant retrievable whipstock.

When a milling tool or other cutting tool is deflected off of a whip stock or other deflection device, a torque may be imparted to the whipstock due to rotation of the cutting tool. This torque may cause the whipstock to become misaligned relative to the well in which it is installed. Where the objective is to cut a window through casing lining the well, it is generally desired for the window to face a particular direction, and misalignment of the whipstock would prevent accurate placement of the window. Therefore, it would be advantageous to provide a whipstock or other deflection device which is capable of resisting torque applied to it.

In a window milling operation, it may be desired to isolate the wellbore below the whipstock from the portion of the wellbore in which the window milling operation is being performed. For this purpose, the whipstock may be sealingly attached to a packer set in the wellbore below the whipstock. In these cases, the packer also serves as an anchoring device for securing the whipstock within the wellbore.

When the whipstock is no longer needed, it may be retrieved from the well, or it may be milled or drilled through to provide access to and fluid communication with the wellbore therebelow. Milling and drilling of the whipstock are sometimes time-consuming operations and do not facilitate later connection of equipment thereto, thus, it would be advantageous to be able to conveniently retrieve the whipstock, while leaving a large diameter seal bore attached to the packer. In this manner equipment could be subsequently sealingly engaged with the seal bore, and equipment could be passed conveniently through the large diameter to the wellbore below the packer.

Unfortunately, where the whipstock has been sealingly attached to the packer during milling or drilling operations, it may prove difficult to disengage the whipstock from the packer. Fluid pressure differences between the wellbore above and below the packer acting on the large diameter seal bore can cause large forces to be imparted to the assembly. Therefore, it would be advantageous to reduce the effects of forces acting on the assembly due to fluid pressure, while still permitting the whipstock to be conveniently separated from the packer and leaving a large diameter seal bore after such separation.

SUMMARY OF THE INVENTION

In carrying out the principles of the present invention, in accordance with an embodiment thereof, a deflection apparatus is provided which resists torque applied thereto, permits sealing engagement between a deflection device and an anchoring device, permits convenient disengagement of the deflection device from the anchoring device under pressure, and leaves a large diameter seal bore after retrieval of the deflection device.

In one aspect of the present invention, a first portion of a deflection device is sealingly connected to a second portion of a deflection device. Each of the first and second portions include profiles. The profiles are cooperatively engaged with each other, thereby preventing rotation between the first and second deflection device portions.

In another aspect of the present invention, a sleeve is sealingly disposed between the first and second portions, the portions being generally tubular and telescopingly arranged housings. The sleeve is sealingly engaged with the first housing at a smaller diameter than that at which the sleeve is sealingly engaged with the second housing. Thus, forces due to fluid pressure acting on the first housing are reduced as compared to the forces which act on the sealing diameter between the sleeve and the second housing.

In still another aspect of the present invention, the first housing may be displaced relative to the sleeve and second housing to permit displacement of the sleeve relative to the second housing. In this manner, the sleeve may be retrieved from within the second housing, leaving the larger sealing diameter between the sleeve and the second housing.

In yet another aspect of the present invention, the first housing maintains a lock member attached to the sleeve in engagement with the second housing, until the first housing is displaced relative to the sleeve and second housing. When the first housing is displaced, the lock member is permitted to disengage from the second housing, thereby permitting the sleeve to be displaced relative to the second housing.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
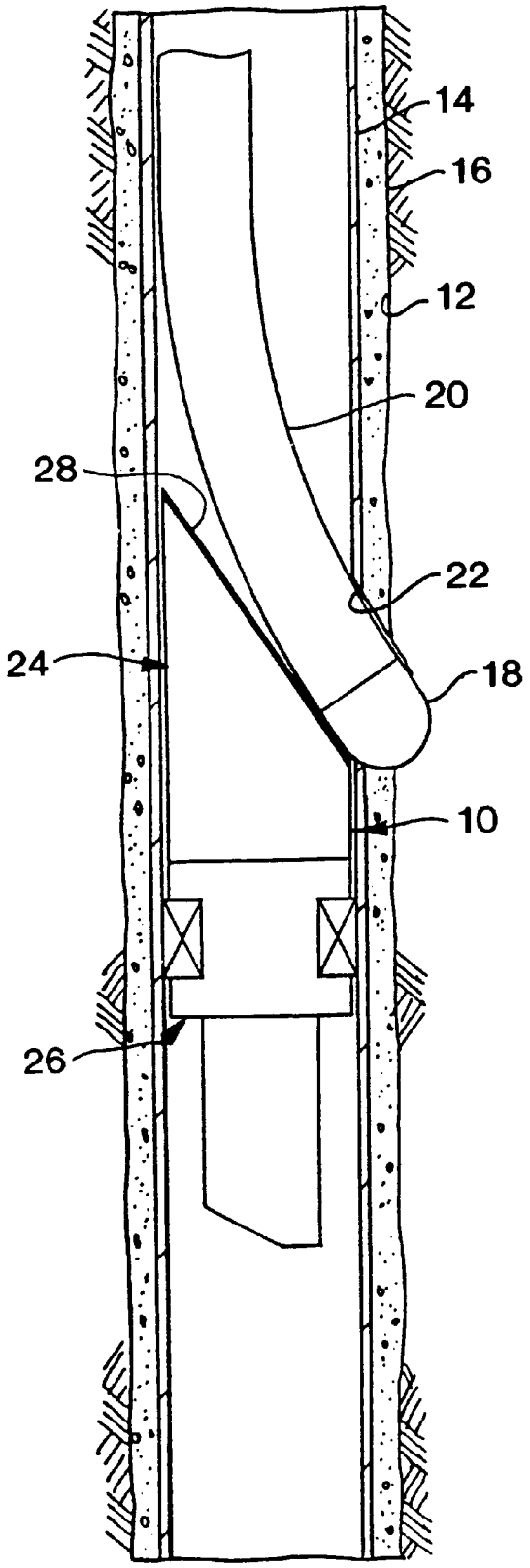
FIG. 1 is a partially cross-sectional and partially elevational schematic view of an apparatus embodying principles of the present invention, the apparatus being installed in a well.

Representatively illustrated in FIG. 1 is a deflection apparatus 10 which embodies principles of the present invention. In the following description of the apparatus 10, directional terms, such as "above", "below", "upper", "lower", etc., are used for convenience in referring to the accompanying drawings. Additionally, it is to be understood that the embodiment of the present invention described herein may be utilized in various orientations, such as inclined, inverted, horizontal, vertical, etc., without departing from the principles of the present invention.

The apparatus 10 is shown in FIG. 1 installed in a wellbore 12, which is lined with protective casing 14 and cement 16. A cutting tool, such as a milling tool 18, has been lowered through the casing 14 on a tubular string 20 and deflected to cut an opening or window 22 laterally through the casing and cement 16. Such operations are performed typically when it is desired to drill a lateral or branch wellbore extending outwardly from a parent or main wellbore, the wellbore 12 being the parent wellbore in this instance. However, it is to be clearly understood that the apparatus 10 may be utilized in other operations without departing from the principles of the present invention.

The apparatus 10 includes a whipstock 24, or other deflection device, uniquely attached to a packer 26, or other anchoring device, in a manner that will be more fully described below. The packer 26 anchors the whipstock 24 within the wellbore 12, with an inclined upper deflection surface 28 of the whipstock facing toward the desired window 22, before the window is cut through the casing 14. The packer 26 sealingly engages the casing 14 below the window-to-be-formed 22, and also uniquely sealingly engages the whipstock 24, in a manner that will be more fully described below. Thus, the wellbore 12 above the apparatus 10 is isolated from fluid communication with the wellbore below the apparatus. It is to be understood, however, that it is not necessary for the wellbore 12 to be so divided into isolated portions, and it is not necessary for the packer 26 to be sealingly engaged with the casing 14 and whipstock 24, according to the principles of the present invention.

The apparatus 10 may be conveyed into the wellbore 12 by any of a variety of methods, such as by lowering it attached to a work string, coiled tubing, slickline, wireline, or any other form of conveyance. The deflection surface 28 is oriented radially toward the window-to-be-formed 22 using techniques well known to those skilled in the art, such as by using a gyroscope, orienting nipple, high-side indicator, etc. The packer 26 is set by any of a variety of methods, depending upon of the type of packer selected, for example, the packer may be set by applying fluid pressure thereto, igniting a propellant charge, manipulating a tubular string on which it is conveyed, etc. Of course, other techniques for conveying the apparatus 10, orienting the whipstock 24 and setting the packer 26 may be utilized without departing from the principles of the present invention.

After the apparatus 10 has been positioned in the wellbore 12, the tubular string 20 and cutting tool 18 are conveyed into the wellbore 12 as shown in FIG. 1. The milling tool 18 is rotated as it is deflected laterally off of the deflection surface 28. For example, the tool 18 could be rotated by rotating the string 20, or a mud motor could be installed in the string 20 to rotate the tool by circulation of mud through the string, etc.

It will be readily appreciated by those skilled in the art that, as the tool 18 and/or the string 20 is cutting through the casing 14 and/or cement 16 while contacting the deflection surface 28, such contact will tend to rotate or induce a torque in the whipstock 24. If the whipstock 24 is permitted to rotate relative to the packer 26, for example, when the tool 18 initially cuts into the casing 14, the deflection surface 28 will no longer face toward the desired position for the window 22. To prevent such undesired rotation of the whipstock 24, the apparatus 10 includes unique torque resistant features, which are described more fully below.

After the window 22 has been cut by the tool 18, and possibly after a lateral wellbore has been drilled outwardly from the wellbore 12 by passing additional cutting tools through the window 22, it may be advantageous to retrieve the apparatus 10, or at least the whipstock 24, or otherwise again permit fluid communication with and access to the wellbore 12 below the window 22. Using conventional techniques, the entire apparatus 10 might be "fished", or the whipstock 24 might be milled through. However, using principles of the present invention, the whipstock 24 can be separately retrieved, leaving a large diameter seal bore attached to an upper end of the packer 26, thus providing a relatively large diameter for subsequent fluid flow and passage of tools and other equipment through the packer 26, and providing a seal bore for sealing attachment of equipment to the packer, if desired. For example, if a lateral wellbore drilled outward from the window 22 is later abandoned, a tubular member, such as a liner may be installed in the casing 14, with the upper end of the liner sealingly engaged with the casing above the window using a liner hanger, and the lower end of the liner sealingly engaged with the seal bore attached to the upper end of the packer 26, thereby isolating the lateral wellbore from fluid communication with the parent wellbore 12. Of course, other tools and items of equipment may be sealingly engaged with the seal bore after retrieval of the whipstock 24, without departing from the principles of the present invention.

Figure 2A:
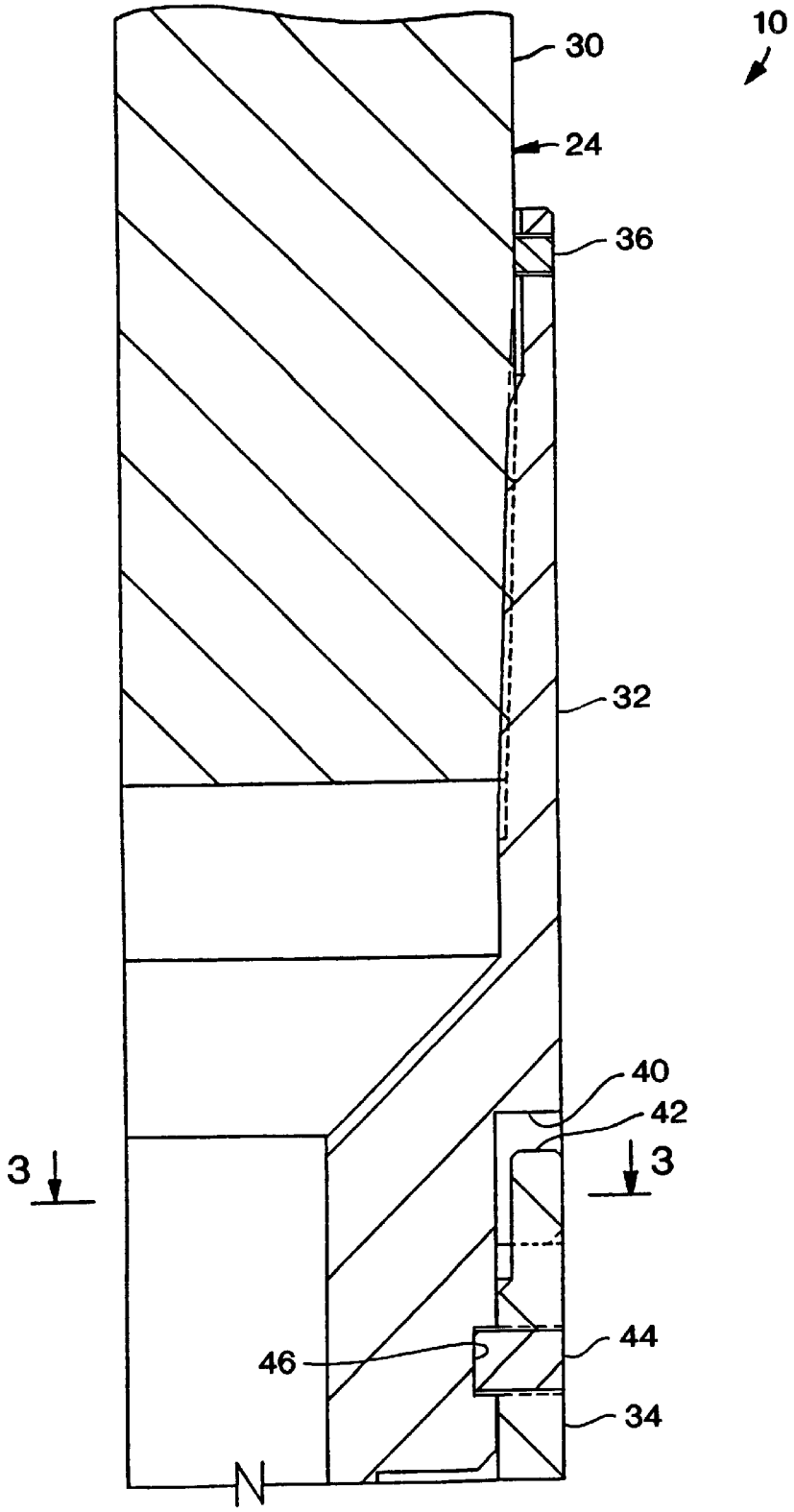
FIGS. 2A & B are enlarged scale quarter-sectional views through the apparatus of FIG. 1.

Referring additionally now to FIGS. 2A & B, an enlarged quarter-sectional view of the apparatus 10 is shown, although only portions of the deflection device 24 and packer 26 are shown, for clear enlarged illustration of the interconnection therebetween. In this view, it may be clearly seen that the deflection device 24 includes an upper deflecting portion 30 on which the deflecting surface 28 is formed, a generally tubular upper housing portion 32 threadedly and sealingly attached to the deflecting portion, and a generally tubular lower housing portion 34 threadedly and sealingly attached to the packer 26. The upper and lower housings 32, 34 are releasably attached to each other in a unique manner that significantly enhances the usefulness of the apparatus 10, and the accuracy, reliability, convenience and economy of operations utilizing the apparatus.

The upper housing 32 is prevented from rotating with respect to the deflecting portion 30 by one or more set screws 36. The lower housing 34 is prevented from rotating with respect to the packer 26 by one or more set screws 38. Thus, although the upper and lower housings 32, 34 are threadedly attached to the deflecting portion 30 and packer 26, respectively, they are not permitted to rotate relative thereto. However, it is to be clearly understood that other means may be utilized for preventing rotation between each of the upper and lower housings 32, 34 and the respective deflecting portion 30 and packer 26, without departing from the principles of the present invention. For example, the upper housing 32 could be attached to the deflecting portion 30 using oring seals and bolts or other fasteners.

Additionally, although the upper and lower housings 32, 34 are shown and described as being portions of the deflecting device 24, it is to be clearly understood that the apparatus 10 could be otherwise configured, without departing from the principles of the present invention. For example, the upper housing 32 could be integrally formed with the deflecting portion 30, the lower housing 34 could be integrally formed with the packer 26, or a portion thereof, etc.

The housings 32, 34 are prevented from rotating with respect to each other by cooperative engagement of profiles 40, 42, respectively, formed thereon. The profiles 40, 42 prevent relative rotation of the housings 32, 34, but still permit relative axial displacement therebetween. Thus, the housings 32, 34 prevent rotation of the deflecting portion 30 relative to the packer 26, thereby resisting torque applied to the deflecting portion, while permitting retrieval of the deflecting portion separate from the packer 26.

Figure 3:
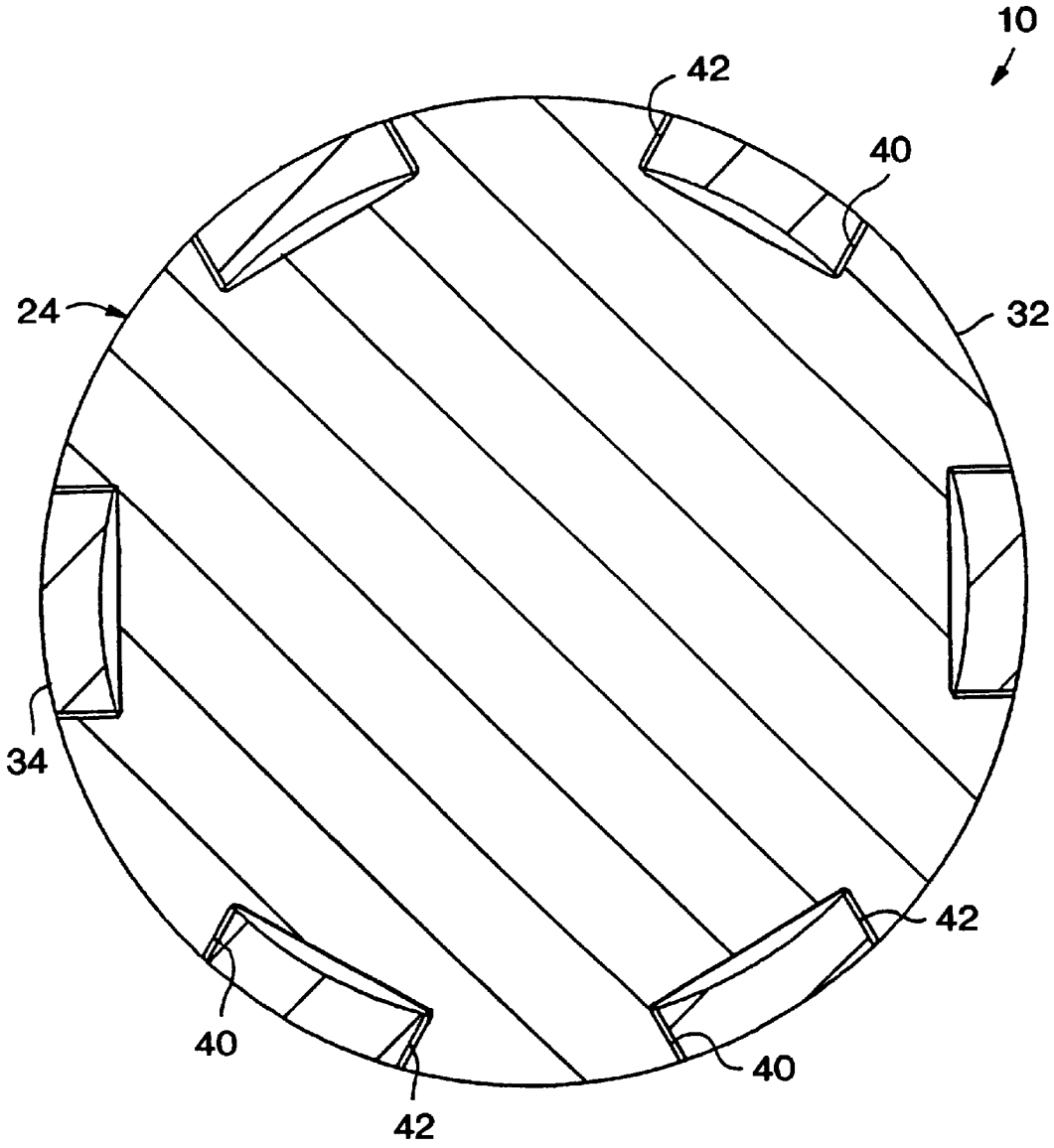
FIG. 3 is a cross-sectional view through the apparatus, taken along line 3—3 of FIG. 2A.

Referring additionally now to FIG. 3, a cross-sectional view of the apparatus 10 is representatively illustrated, taken along line 3—3 of FIG. 2A. In this view it may be seen that the profile 40 comprises a series of circumferentially spaced apart downwardly opening recesses formed on the upper housing 32, and the profile 42 comprises a series of upwardly extending projections formed on the lower housing 34. Of course, other types of cooperating profiles may be used, and the profiles may be otherwise positioned and configured, without departing from the principles of the present invention.

Referring again to FIGS. 2A & B, a shear screw 44 is shown threadedly installed through the lower housing 34 and into a recess 46 formed externally on the upper housing 32. The shear screw 44 prevents relative axial displacement between the housings 32, 34, until a predetermined force is applied upwardly to the deflecting device 24. Such upward force may be applied to the deflecting device 24 by any conventional technique, such as by a retrieval tool or fishing tool engaged therewith, etc.

The housings 32, 34 are sealingly engaged with each other by means of a sleeve 48 disposed radially between the housings. The sleeve 48 is sealingly engaged with a seal bore 50 formed internally on the lower housing 34, and with a seal surface 52 formed externally on the upper housing 32. Thus, the sleeve 48 is sealingly engaged radially between the housings 32, 34.

The sleeve 48 is releasably secured against axial displacement relative to the lower housing 34 by one or more locking members or keys 54. Preferably, the keys 54 are circumferentially spaced apart, radially slidingly received in openings 56 formed radially through the sleeve 48, and received in an annular recess 58 formed internally on the lower housing 34. The keys 54 are prevented from radially inwardly displacing out of engagement with the recess 58 by the surface 52 on the upper housing 32.

It may now be fully appreciated that the sealing engagement of the sleeve 48 between the housings 32, 34 acts to reduce forces due to pressure on the upper housing 32. This is due to the fact that the sleeve 48 is secured to the lower housing 34 and sealingly engaged therewith at the seal bore 50, which has a diameter greater than the seal surface 52 where the sleeve is sealingly engaged with the upper housing 32. Thus, fluid pressure acts on a smaller piston area with respect to the upper housing 32 than it would if, for example, the upper housing were directly sealingly engaged with the seal bore 50. Reducing the forces due to fluid pressure acting on the upper housing 32 produces many benefits, among these being that the shear screws 44 do not have to resist the greater forces, thus the predetermined upward force needed to shear the shear screws may be lessened, the upper housing 32 may have smaller cross-sections or may be made of less expensive materials, etc. Of course, the lower housing 34 could be directly sealingly engaged with the upper housing 32 at the seal surface 52, without departing from the principles of the present invention, but this would undesirably decrease the bore left in the lower housing when the upper housing is removed therefrom.

As described above, it is desired for the relatively large diameter seal bore 50 to be open for passage of fluid flow, equipment, etc. after the upper housing 32 is retrieved with the deflecting portion 30. In a unique manner, upward displacement of the upper housing 32 relative to the lower housing 34 permits the sleeve 48 to be released from its engagement with the lower housing, and the sleeve is retrieved along with the upper housing, leaving the seal bore 50 open.

Figure 2B:
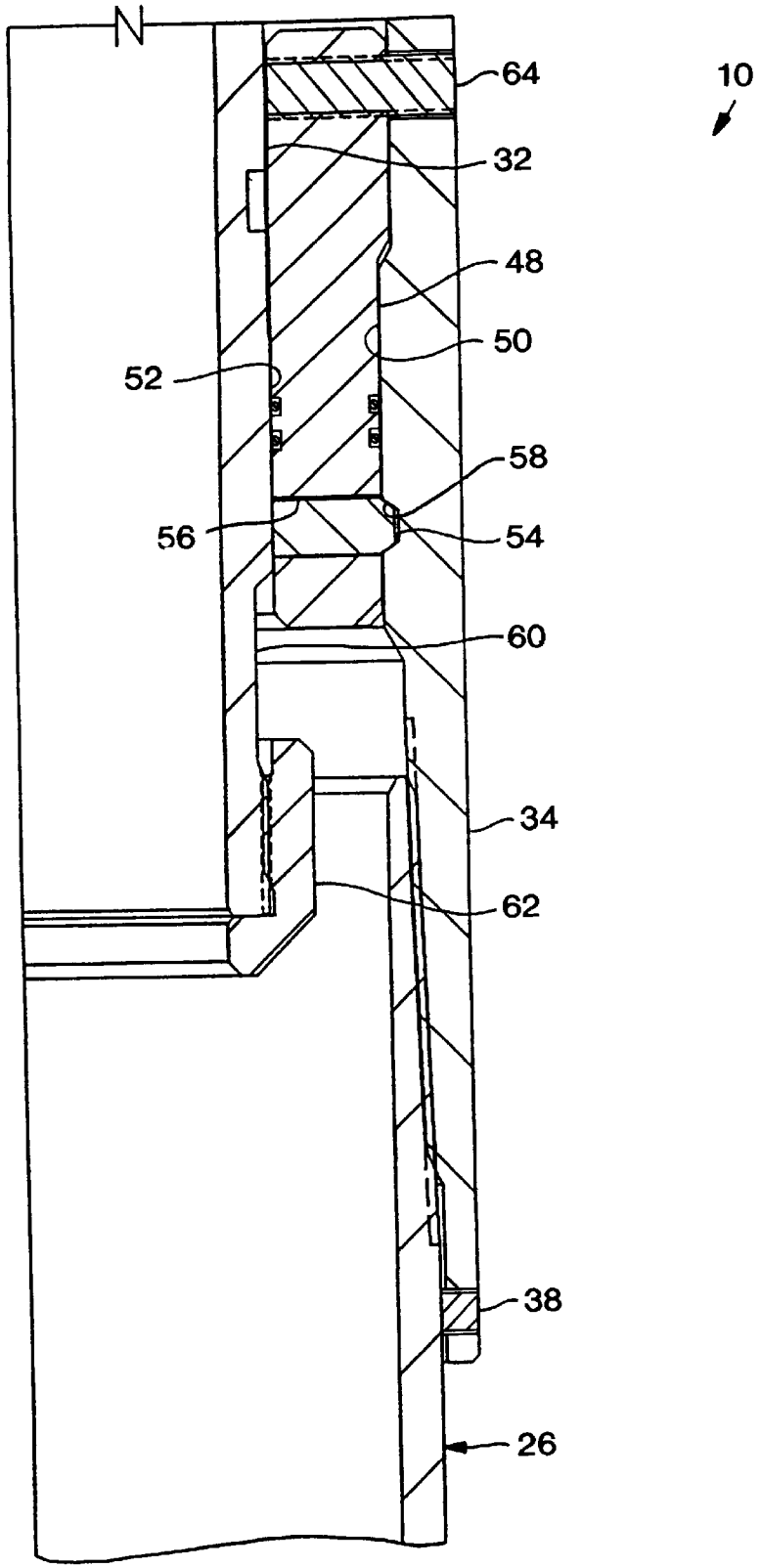

Note that, as shown in FIG. 2B, the keys 54 are maintained in engagement with the recess 58 by the seal surface 52 being disposed radially opposite the keys. When, however, the upper housing 32 is displaced upwardly, shearing the shear screws 44, a radially reduced external surface 60 formed on the upper housing 32 will be displaced upwardly and will be positioned opposite the keys 54. The surface 60 will permit the keys 54 to radially inwardly retract out of engagement with the recess 58. It is to be clearly understood, however, that other means of releasing the sleeve 48 for displacement relative to the lower housing 34 may be utilized without departing from the principles of the present invention. For example, the sleeve 48 could have collets formed thereon which engage the recess 58, one or more locking members, such as a snap ring could be carried on the lower housing 34, etc.

After the upper housing 32 has been upwardly displaced and the keys 54 have disengaged from the recess 58, a somewhat radially enlarged end cap portion 62 threadedly attached to the upper housing 32 will axially contact the sleeve 48. An optional shear screw 64 prevents displacement of the sleeve 48 relative to the lower housing 34 until a predetermined upward force is applied to the sleeve. When the shear screw 64 has been sheared, the deflecting portion 30, upper housing 32 and sleeve 48 may be retrieved, leaving the lower housing 34 attached to the packer 26.

Of course, many modifications, additions, substitutions, deletions, and other changes may be made to the apparatus 10 described above, which changes would be obvious to those skilled in the art, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. Apparatus operatively positionable within a subterranean well, the apparatus comprising:

a first deflection device portion including a first profile; and a second deflection device portion including a second profile, the first and second profiles being cooperatively engaged and preventing relative rotation between the first and second deflection device portions, the first and second deflection device portions being sealingly engaged with each other.

2. The apparatus according to claim 1, wherein the engagement between the first and second profiles permits relative axial displacement between the first and second deflection device portions.

3. The apparatus according to claim 1, wherein the first deflection device portion is releasably secured against axial disengagement from the second deflection device portion.

4. The apparatus according to claim 1, further comprising a shear member preventing displacement of the first deflection device portion relative to the second deflection device portion, the shear member permitting such displacement when a predetermined force is applied to the first deflection device portion.

5. Apparatus operatively positionable within a subterranean well, the apparatus comprising:

a first deflection device portion including a first profile;

a second deflection device portion including a second profile, the first and second profiles being cooperatively engaged and preventing relative rotation between the first and second deflection device portions; and a third deflection device portion sealingly engaged with each of the first and second deflection device portions.

6. The apparatus according to claim 5, wherein a first piston area is formed by the sealing engagement between the first and third deflection device portions, and wherein a second piston area is formed by the sealing engagement between the second and third deflection device portions.

7. The apparatus according to claim 6, wherein the first piston area is smaller than the second piston area.

8. The apparatus according to claim 5, further comprising a shear member preventing displacement of the first deflection device portion relative to the second deflection device portion, the shear member permitting such displacement when a predetermined force is applied to the first deflection device portion.

9. The apparatus according to claim 5, wherein the third deflection device portion is releasably secured against axial displacement relative to the second deflection device portion by at least one lock member.

10. The apparatus according to claim 9, wherein the at least one lock member is a series of radially extendable members.

11. The apparatus according to claim 10, wherein each of the members is slidingly disposed in one of a series of openings formed through the third deflection device portion.

12. The apparatus according to claim 10, wherein each of the members is received in a recess formed in the second deflection device portion.

13. The apparatus according to claim 9, wherein the lock member is maintained in engagement with the second deflection device portion by the first deflection device portion.

14. The apparatus according to claim 9, wherein the first deflection device is selectively axially displaceable between first and second positions relative to the second deflection device portion, the first deflection device portion outwardly supporting the lock member in engagement with the second deflection device portion in the first position, and the first deflection device permitting the lock member to inwardly disengage from the second deflection device in the second position.

15. The apparatus according to claim 9, further comprising a shear member preventing displacement of the third deflection device portion relative to the second deflection device portion, the shear member permitting such displacement when a predetermined force is applied to the third deflection device portion.

16. The apparatus according to claim 15, wherein the first deflection device portion is selectively axially displaceable between first and second positions relative to the second deflection device portion, the first deflection device portion outwardly supporting the lock member in engagement with the second deflection device portion in the first position, the first deflection device permitting the lock member to inwardly disengage from the second deflection device portion, and permitting the first deflection device portion to axially engage the third deflection device portion and shear the shear member, in the second position.

17. Deflection apparatus operatively positionable in a subterranean well, the apparatus comprising:

a whipstock;

a packer; and a release device sealingly interconnected between the whipstock and the packer, the release device preventing rotation of the whipstock relative to the packer, but permitting axial separation of the whipstock from the packer.

18. The apparatus according to claim 17, wherein the release device includes first and second tubular and telescopingly engaged housings, and a sleeve sealingly engaged radially between the first and second housings.

19. The apparatus according to claim 18, wherein each of the first and second housings has a profile formed thereon, the profiles being cooperatively engaged and preventing rotation of the first housing relative to the second housing, but permitting axial displacement of the first housing relative to the second housing.

20. The apparatus according to claim 18, wherein the first housing is releasably secured against axial displacement relative to the second housing.

21. The apparatus according to claim 18, further comprising a shear member releasably preventing axial displacement of the first housing relative to the second housing.

22. The apparatus according to claim 18, wherein the sleeve is releasably secured against axial displacement relative to the second housing by at least one lock member.

23. The apparatus according to claim 22, wherein the lock member is engaged with a recess formed internally on the second housing.

24. The apparatus according to claim 22, wherein the first housing outwardly supports the lock member in engagement with the second housing.

25. The apparatus according to claim 24, wherein the first housing is displaceable relative to the second housing to a position in which the lock member is permitted to disengage from the second housing.

26. The apparatus according to claim 18, wherein the sleeve is releasably secured against axial displacement relative to the second housing by a shear member.

* * * * *